United States Patent [19]

Mattox et al.

[11] 4,385,760

[45] May 31, 1983

[54] ISOKINETIC EXERCISER

[75] Inventors: E. Michael Mattox; E. Dale Mask, both of Blue Springs, Mo.; Jack D. Beeding, Rockford, Ill.

[73] Assignee: Newmark Industries, Inc., Blue Springs, Mo.

[21] Appl. No.: 71,062

[22] Filed: Aug. 30, 1979

[51] Int. Cl.[3] ..... A63B 21/00

[52] U.S. Cl. ..... 272/131; 272/132; 272/125; 188/67

[58] Field of Search ..... 272/125, 126, 128, 131, 272/132, 133, 134, 137, 138; 188/67

[56] References Cited

U.S. PATENT DOCUMENTS

| | | | |
|---|---|---|---|
| 1,707,791 | 4/1929 | Anderson | 272/131 |
| 2,832,334 | 4/1958 | Whitelaw | 272/131 X |
| 3,190,648 | 6/1965 | Kallenbach | 272/125 |
| 3,298,688 | 1/1967 | Grzybowski | 272/131 |
| 3,424,280 | 1/1969 | Hettich | 188/67 |
| 3,589,720 | 6/1971 | Agamian | 272/131 |
| 3,637,205 | 1/1972 | Bankston | 272/131 |
| 3,811,672 | 5/1974 | Simmons | 272/131 |
| 4,208,049 | 6/1980 | Wilson | 272/138 |

*Primary Examiner*—Richard J. Johnson

*Attorney, Agent, or Firm*—Schmidt, Johnson, Hovey & Williams

[57] ABSTRACT

A slide is confined for travel along a guide having a surface which can be interengaged by one or more friction pads on the slide. An operating lever rigid to the slide and projecting outwardly therefrom may be grasped at its outer end for the purpose of operating the slide, and because the slide is loosely confined on the guide, the user-applied force on the lever rocks the slide in a direction to press the friction component or components tightly against the cooperating surface of the guide to produce frictional resistance as the slide travels along the guide. The pads may be adjustably positioned in any one of a number of locations for achieving variation in resistance generated by the exerciser, and the lever is itself extensible for adjustment of the moment arm between the end of the lever and the surface of the surface engaged by the friction pads. A variety of embodiments are disclosed including a rectilinear form and a curvilinear form.

11 Claims, 10 Drawing Figures

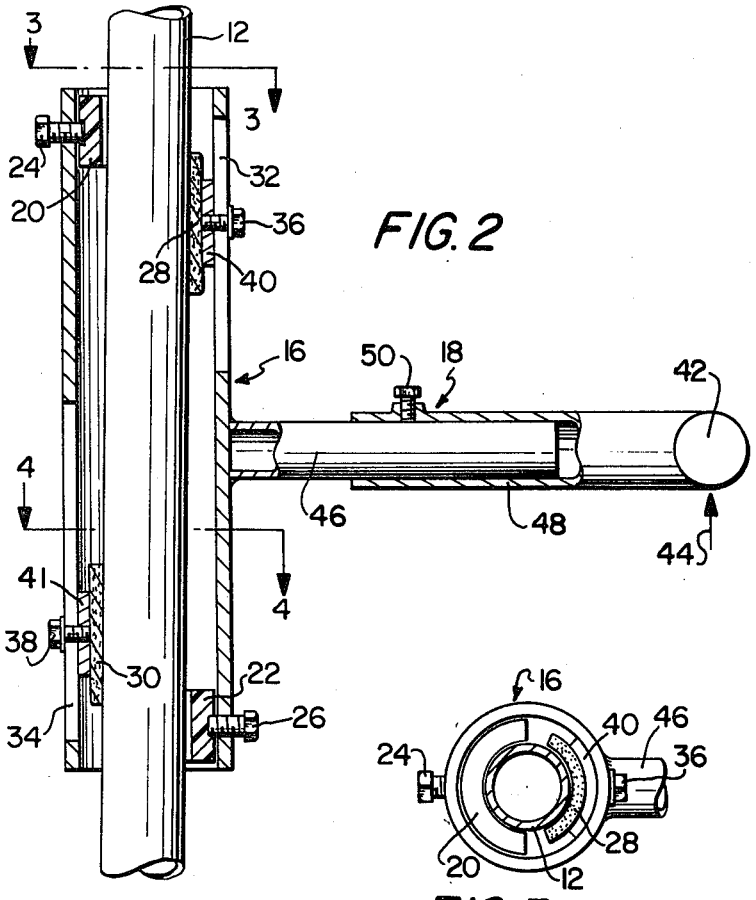
FIG. 2
FIG. 3
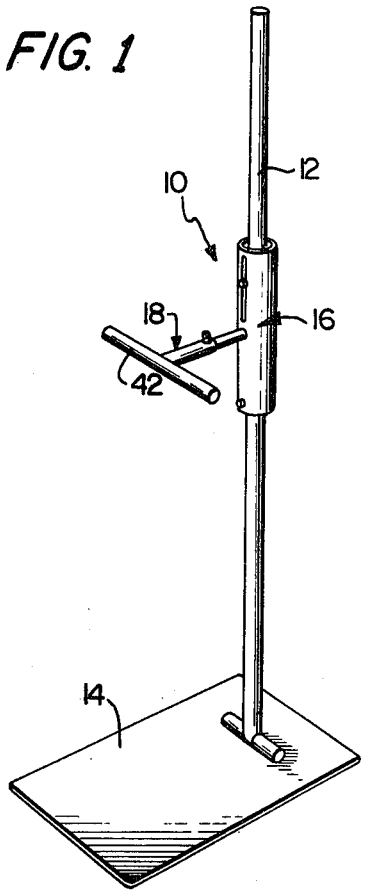
FIG. 1
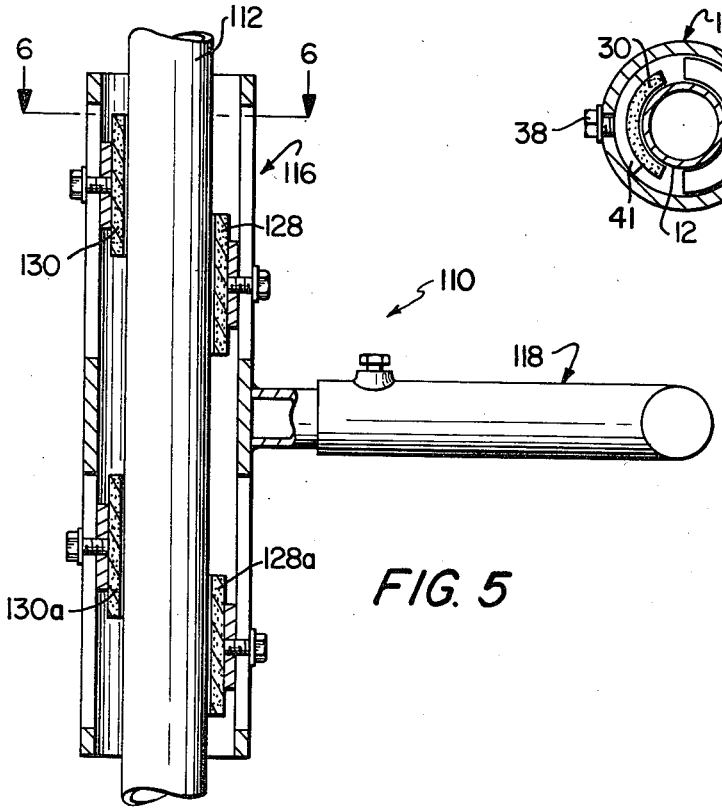
FIG. 5
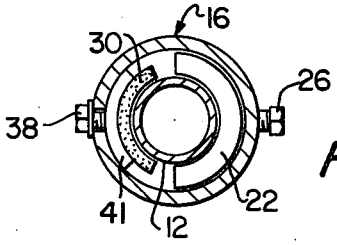
FIG. 4
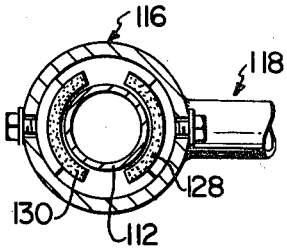
FIG. 6

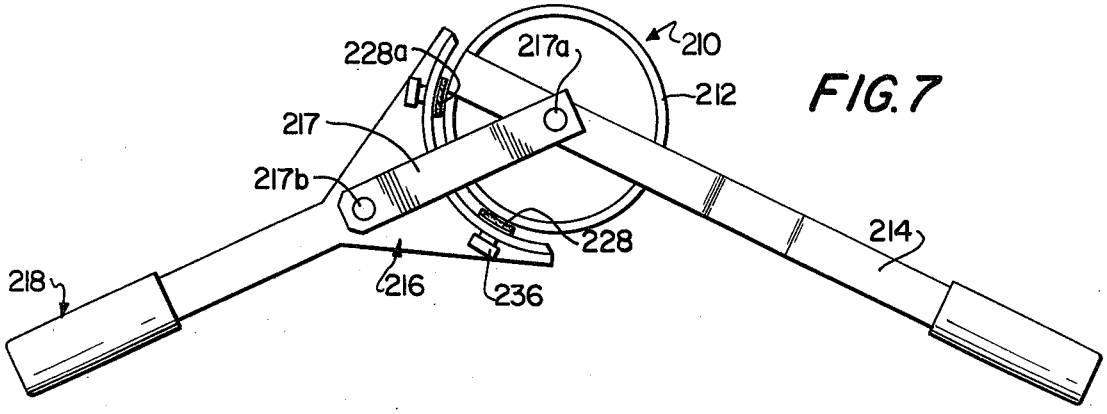
FIG. 7
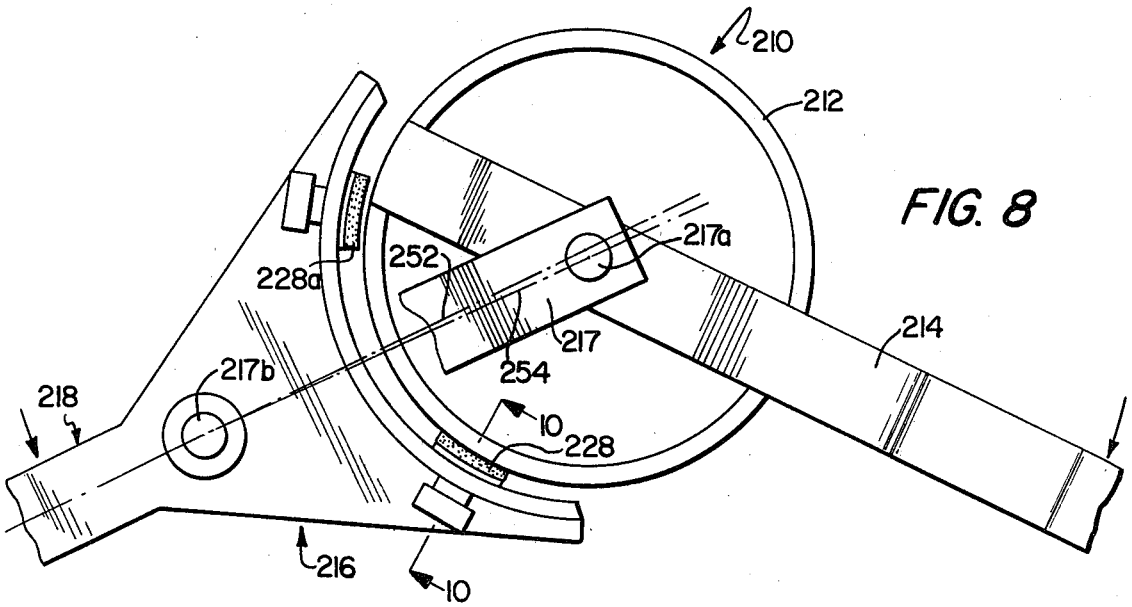
FIG. 8
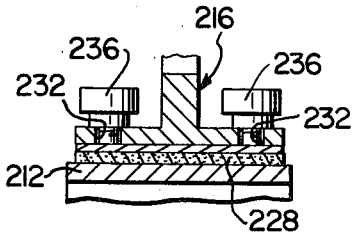
FIG. 10
FIG. 9
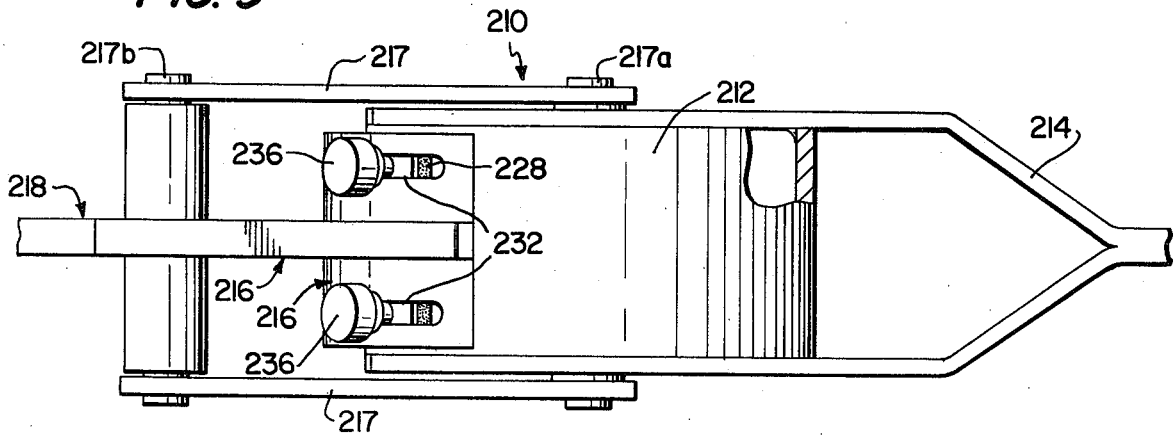

ISOKINETIC EXERCISER

TECHNICAL FIELD

This invention relates to exercising equipment of the isokinetic type.

BACKGROUND ART

As is well understood by those skilled in the art, isokinetic exercising equipment offers a distinct advantage over other forms of exercising devices in that it will permit the user to complete a full exercising stroke under conditions in which the resistance generated by the equipment fully matches the effort expended by the user at all points throughout the stroke. While with a barbell or the like the user has a constant weight or resistance which is overcome with increasing ease throughout the exercising stroke as the leverage, pivot points and moment arms associated with contraction of the user's muscles change throughout the stroke to obtain an increasing mechanical advantage over the weight, in isokinetics the progressively increasing advantage obtained by the user may result in the application of additional energy and speed to the equipment which is in turn matched by increased resistance of the latter to movement. Consequently, the user's muscles can be taxed to the same extent both at the beginning and end of the exercising stroke. Moreover, the amount of resistance generated by the equipment is customized to the physical characteristics of the user (weak or strong) simply by virtue of the amount of energy imparted to the equipment by the user.

Many prior isokinetic devices have, however, suffered from untoward complexity. Thus, they have been somewhat costly, have required more frequent maintenance, have occupied excessive space, and have been otherwise less than fully satisfactory.

SUMMARY OF THE INVENTION

In view of the foregoing, an important object of the present invention is to provide a substantially simplified isokinetic device which, while providing the many benefits inherent in such simplification, in no way sacrifices, and in fact in many aspects improves upon, the fundamental principles of isokinetics.

Pursuant to the above, the isokinetic exerciser of the present invention includes a slide movable along a guide member via a lever or other suitable contrivance by which the user can apply a moving force to the slide. The slide is confined on the guide in such a manner that when the user applies a force to the lever tending to move the slide along the guide, the slide is rocked in a direction pressing a friction pad of the slide against the proximal surface of the guide, thereby generating frictional resistance to the efforts of the user to move the slide. The magnitude of friction force resisting movement of the slide is a function of the effort expended by the user and the speed at which he attempts to move the slide.

The device may be set up for generating a resistance only in one direction of slide movement if desired, or, it can be arranged to create resistance during reciprocating movements of the slide. Furthermore, the total resistance of the slide to movement can be adjusted by repositioning the friction pad or pads in a way to change the length of the moment arm between the same and the operating lever; and the lever is extensible so that the length of its moment arm with the frictional surface of the guide can likewise be adjusted. The concepts of the invention can be embodied in a variety of forms, including a purely rectilinear unit or a curvilinear unit.

BRIEF DESCRIPTION OF THE DRAWINGS

FIG. 1 is a right front perspective view of one form of isokinetic exerciser embodying the principles of the present invention;

FIG. 2 is an enlarged, fragmentary, vertical cross-sectional view thereof showing details of construction and illustrating the slide rocked by the operating lever in a direction to engage its friction pads with the upright guide during an upward exercising stroke;

FIG. 3 is a fragmentary transverse cross-sectional view of the exerciser taken substantially along line 3—3 of FIG. 2;

FIG. 4 is a transverse cross-sectional view through the exerciser taken substantially along line 4—4 of FIG. 2;

FIG. 5 is an enlarged, fragmentary vertical cross-sectional view through a second form of the exerciser showing the use of additional friction pads and the way in which the operating lever can be adjustably positioned;

FIG. 6 is a fragmentary, transverse cross-sectional view through the exerciser of FIG. 5 taken substantially along line 6—6 of FIG. 5;

FIG. 7 is a plan view of another embodiment of the present invention in which the principles thereof are adhered to in a curvilinear concept;

FIG. 8 is an enlarged, fragmentary plan view thereof illustrating the way in which a friction pad of the slide is pressed into frictional engagement with the arcuate surface of the guide therefore;

FIG. 9 is a fragmentary elevational view thereof rotated 90° from the FIG. 8 orientation; and FIG. 10 is an enlarged, fragmentary cross-sectional view through one of the friction pads and associated structure of the exerciser illustrating details of construction.

DETAILED DESCRIPTION

The exerciser 10 of FIG. 1 includes an upright, elongated and rectilinear member or guide 12 attached at its lower end to a platform 14 on which the user may stand while operating the exerciser 10. The guide 12 has been illustrated herein as being tubular and of circular cross section, although it will be apparent to those skilled in the art that many variations on this configuration could be utilized without departing from the principles of the present invention.

The exerciser 10 also includes a slide 16 herein illustrated as being in the form of a tubular sleeve receiving the guide 12. Slide 16 is in turn adapted to be moved along the guide 12 via an operating lever 18 grasped by the user during the exercising stroke.

The slide 16 is relatively loosely confined on the guide 12 such that if an upwardly or downwardly directed force is applied to the slide 16 in a direction parallel to the guide 12 and close to its longitudinal axis, the slide 16 will readily move. To assist in properly confining the slide 16, the latter is provided with a pair of generally semicircular, preferably nylon blocks 20 and 22 located on diametrically opposite sides of the guide 12 and on vertically opposite sides of the operating lever 18. The blocks 20, 22 are held in place by suitable fasteners 24 and 26 respectively, such fasteners 24, 26 permitting the in-and-out positions of the blocks 20, 22 to be adjusted to the extent necessary or desirable to provide the relatively loose fit between the slide 16 and the guide 12 when no force is applied to the outer end of the operating lever 18.

As a result of the loose relationship between the slide 16 and the guide 12, the slide 16 may be rocked slightly into a skewed or canted relationship with the guide 12 as illustrated for example in FIG. 2. A pair of friction components or pads 28, 30 are carried by the slide 16 in such a way that when the latter is rocked in a counter-clockwise direction such as illustrated in FIG. 2, the pads 28, 30 are pressed into frictional engagement with the proximal surface of the guide 12 to the extent determined by the amount of rocking force applied to the guide 16. Consequently, the guide 12 on the one hand and the slide 16, pads 28, 30 on the other hand effectively comprise a pair of frictionally interengageable structures that can be relatively shifted by operating means comprising the lever 18 but which are also maintained by the lever rocked into said frictional interengagement upon the application of manual force to the lever 18 tending to effect said relative shifting of the structures.

As illustrated, the pads 28 and 30 are situated on diametrically opposed sides of the guide 12 and are likewise disposed on opposite, upper and lower sides of the operating lever 18. A pair of corresponding, vertically disposed slots 32 and 34 are provided in the slide 16 on opposite sides of the latter to provide means by which corresponding fasteners 36 and 38 of the pads 28 and 30 may be loosened and moved longitudinally within their respective slots 32, 34 for the purpose of adjusting the position of the pads 28, 30 with respect to the lever 18. Such adjustment likewise adjusts the length of the moment arm between the pads 28, 30 and the longitudinal axis of the lever 18 which has a direct bearing upon the amount of resistance generated by the exerciser 10 during use. Backup pieces 40 and 41 may be utilized behind the pads 28 and 30 respectively for structural support purposes if desired. The pads 28, 30 may be constructed of a leather material or any other material which will provide a suitable frictional drag along the guide 12 to the degree contemplated hereby.

The operating lever 18 is extensible such that the outer gripping end 42 thereof, of generally T-shaped configuration, can be adjusted toward and away from the slide 16. This thereby adjusts the length of the moment arm between the outer end 42 and the surface of the guide 12 with respect to an operating force applied to the lever 18 at the outer end 42 such as in the direction of the arrow 44 in FIG. 2. A shank 46 of the handle 18 is welded or otherwise rigidly affixed to the slide 16 and projects outwardly therefrom in perpendicular relationship thereto, while a tubular portion 48 of the lever 18 telescopes over the shank 46 and may be shifted along the latter to provide the aforementioned moment arm adjustment when a set screw 50 is released.

Operation

The slide 16 normally can be moved freely along the guide 12 with little or no frictional drag between the latter and the pads 28, 30. However, when the user stands on the platform 14 and applies a lifting force in the direction of the arrow 44 to the outer end 42 of the upper lever 18, the slide 16 is caused to rock out of its normally concentric relationship with the guide 12 into a skewed relationship therewith so that the pads 28 and 30 are pressed tightly into frictional engagement with the surface of the guide 12. Consequently, as the user attempts to raise the slide 16 via the lever 18, the slide 16 resists to the extent of the friction force generated between the pads 28, 30 and the guide 12. Such resistance continues throughout the lifting stroke and increases or decreases to match the effort expended by the user throughout the entire stroke.

In this regard, as leverage and geometry factors permit the user's muscles to gain an increasingly better mechanical advantage over the exerciser 10 as the stroke continues, any increase in speed as a result of this increased advantage simply is responded to by increased resistance from the exerciser 10 so that the user's muscles are indeed taxed fully throughout their entire contracting range. Likewise, if increased mechanical advantage by the user permits the input of greater lifting force to the lever 18, the exerciser 10 simply responds with matched output resistance.

The relationship between the resistance generated by the exerciser 10 and the force exerted by the user can be adjusted readily if such is desired. For example, by loosening the fasteners 36, 38, the pads 28, 30 can be positioned closer to or farther away from the longitudinal axis of the operating lever 18 to likewise adjust the length of the moment arms between pads 28, 30 and the lever 18. For example, if the pad 28 is adjusted downwardly from its FIG. 2 position so as to decrease the length of its moment arm with the lever 18, the lifting force applied to the outer end 42 of the lever 18 will thereby have increased mechanical advantage over the pad 28, resulting in increased resistance to movement of the slide 16 upwardly along the guide 12. As the pad 28 is moved down close to the lever 18, the resistance can become quite excessive, depending upon the length of the lever 18.

Likewise, adjustment of the force relationship may be obtained by adjusting the length of the lever 18. When the set screw 50 is released and the outer end 42 is telescoped outwardly of its FIG. 2 position, the length of the moment arm between the outer end 42 and the surface of the guide 12 is increased, thereby once again increasing the mechanical advantage of the lifting force applied to the outer end 42 over the pads 28 and 30. Consequently, resistance to lifting is likewise increased. The opposite is true if the outer end 42 is shifted inwardly toward the slide 16 to decrease the length of the moment arm between the outer end 42 and the guide 12.

Alternative Embodiments

It will be appreciated that many variations on the above described embodiment could be achieved without departing from the principles of the present invention. For example, although the slide 16 has been illustrated as utilizing a pair of friction pads 28, 30, it may be desirable for only one of such pads to be utilized, it being understood that by using a pair of the pads 28, 30, their resistance to movement is combined into a greater total resistance than would otherwise be true with only a single pad.

Furthermore, it might be desired to obtain resistance in both directions of movement of the slide 16 so that the user can complete an exercising stroke in a downward direction as well as an upward direction. This may be accomplished using an exerciser 110 as illustrated in FIG. 5 in which the slide 116 has a pair of the pads 128 and 128*a* located both on the same side of the guide 112. Thus, as the slide 116 is rocked in a counter-clockwise direction during an up stroke, the upper pad 128 wipes along the guide 112, and when the slide 116 is rocked in a clockwise direction during a down stroke, the lower pad 128*a* wipes along the guide 112.

The slide 116 in FIG. 5 is also provided with a second set of pads 130 and 130*a* in opposition to the pads 128 and 128*a*. This doubles the resistance to movement of the slide 116 in the manner above explained with respect to the slide 16 and the pads 28, 30. Thus, as the slide 116 is rocked counter-clockwise during a lifting stroke of the lever 118, the pads 128 and 130*a* wipe along the guide 112, while when the slide 116 is rocked in a clockwise direction during a down stroke via the lever 118, the pads 130 and 128*a* wipe along the guide 112.

FIGS. 7–10 illustrate an arrangement in which a totally hand-held exerciser 210 embodies the concepts of the present invention for curvilinear operation as opposed to the purely rectilinear operation of the exercisers 10 and 110 above described. Here the guide 212 is circular so as to have an arcuate outer periphery, and instead of a platform 14, the guide 212 is provided with a handle 214 which is gripped in one hand by the user. The handle 214 is rigid to the guide 212, and the latter may be annular or solidly cylindrical in configuration as may be desired.

A slide 216 is confined to movement along the surface of the guide 212 via a pair of straps 217 which are somewhat akin to the blocks 20 and 22 of the embodiment of FIGS. 1–4. Each strap 217 is swingably attached to the guide 212 via a pivot 217*a* which connects the straps 217 directly to the handle 214, the latter in turn being rigid to the guide 212 as above explained. There is a second pivot 217*b* at the opposite end of the straps 217 with the slide 216 such that the latter can rock about the pivot 217*b* relative to the guide 212. An operating lever 218 is rigid to the slide 216 and projects outwardly from the latter and from the guide 212 in a radial direction.

The slide 216 is relatively free to move about the guide 212 unless exercising forces are applied to the outer end of the handle 214 and the lever 218 to move the latter toward or away from one another. In that event, the slide 216 is rocked about pivot 217*b* causing one or the other of a pair of friction pads 228 and 228*a* respectively to press against the exterior surface of the guide 212 so as to resist movement of the slide 216 about the guide 212. This is illustrated in FIG. 8 wherein it may be seen that when forces are applied to the outer ends of the handle 214 and te lever 218 in the direction of the arrows, the longitudinal axis 252 of the lever 218 is cocked to one side of the center line 254 between the pivots 217*a* and 217*b*, causing the pad 228 to be pressed against the outer surface of the guide 212. Thus, continued movement of the handle 214 and the lever 218 toward one another in the direction of the arrows in FIG. 8 generates continued resistance to the user's efforts. If the handle 214 and the lever 218 are pulled apart, the slide 216 becomes cocked in the opposite direction to press the pad 228*a* into wiping engagement with the outer surface of the guide 212.

As illustrated in FIGS. 9 and 10 with respect to the pad 228, the pads 228 and 228*a* are adapted for adjustable positioning on the slide 216 in a manner corresponding to that of the embodiments of FIGS. 1–4 and 5, 6. In this regard, a pair of longitudinally arcuate slots 232 in the arcuate portion of the slide 216 permit respective fasteners 236 for the pad 228 to be shifted lengthwise within the slots 232 when fasteners 236 are loosened. This effectively results in adjusting the length of the moment arm between the pad 228 and the longitudinal axis 252 of the operating lever 218. Although not shown, it is also to be understood that the lever 218 could be extensible if desired as could also be the handle 214, all of which results in the ability to adjust the resistance generated by the exerciser 210 when operated by a user.

It will also be noted that if the guide 212 is constructed as shown in which it is of annular configuration, an inner annular surface is presented in addition to the outer annular surface thereof presently illustrated as being engaged by the pads 228 and 228*a*. Thus, although not shown, it is to be understood that additional friction pads could be mounted on the slide 216 in such a way as to wipe along the inner peripheral surface of the guide 212 if desired in order to increase the resistance generated by the exerciser 210. This would be analogous to the arrangement of FIGS. 5 and 6.

It is to be noted that as the friction pads 228, 228*a* are progressively adjusted further away from the longitudinal axis 252 of the handle 218, the friction force generated is correspondingly reduced. If and when the pads 228, 228*a* are shifted so far away from the axis 252 as to be beyond a tangent point of a line drawn from the pivot 217*b* to the outer periphery of the guide 212, the friction pads 228 and 228*a* become completely ineffective in generating frictional drag. Thus, if desired, although two or more of the pads 228 and 228*a* may be used on the exerciser 210, it is entirely possible and quite easy to "disable" one or more of the pads by simply shifting it beyond such tangent point while using the other pad for friction purposes by keeping it located between the tangent point and the longitudinal axis 252.

It is to be appreciated that a great many benefits can be obtained in the isokinetic exerciser of the present invention compared to those currently available. For example, it can be produced relatively inexpensively. No one-way clutch is required in conjunction with spinning components or the like; resistance may be obtained in two opposite directions of exercising stroke without having to overcome inertial forces during the changing of directions; and extremely great latitude in speed of exercising stroke is obtainable; the unit is quiet to operate; it utilizes no fluids, oils or the like which might leak; and it has no gears, chains, bearings, sprockets and the like to wear out and complicate the mechanism. It can be easily maintained and it can also be adapted to virtually any type of exerciser, large or small.

I claim:

1. An isokinetic exerciser comprising:

a pair of frictionally interengageable structures; and manually operated means associated with said structures for effecting relative shifting thereof while the same are frictionally interengaged, said means being disposed to maintain said structures rocked into said interengagement upon the application of manual force to the means tending to effect said relative shifting, one of said structures including a surface, said other structure including a slide mounted for movement along said surface and a friction component carried by said slide in disposition for wiping engagement with said surface during said movement of the slide, said means including a lever rigid to said slide and adapted to receive the application of said manual force at a point spaced outwardly from said surface for rocking the component toward said surface as the force moves the lever, slide, and friction component along said surface, said lever being extensible for adjusting the length of the moment arm between said surface and the point at which said manual force is applied to the lever.

2. An isokinetic exerciser as claimed in claim 1, wherein said slide is provided with means for adjusting the position of the component on said slide in a direction to adjust the length of the moment arm between the component and said lever.

3. An isokinetic exerciser as claimed in claim 1, wherein said other structure further includes a second friction component in addition to said first-mentioned component, said components being located on opposite sides of the longitudinal axis of said lever in disposition for maintaining said first component in engagement with said surface when the lever is rocked in one direction and for maintaining said second component in engagement with said surface when the lever is rocked in the opposite direction.

4. An isokinetic, muscular exerciser for the human body comprising:

muscle-force opposing structure presenting a surface that generates a resistive force opposing the muscular force applied by the human body during use;

muscle-operated friction slide means reciprocably coupled with said structure for repeated movement in successive exercising strokes along said surface, said slide means being coupled with said structure in a manner to permit the slide means to rock about an axis transverse to the path of reciprocation of the slide means in opposite directions between a first position bearing frictionally against the structure and a second position essentially releasing such frictional engagement with the structure, said slide means including a friction pad which is spaced from said axis in a longitudinal direction with respect to the path of reciprocation of the slide means and which is disposed loosely adjacent the structure when the slide means is in said second, releasing position; and a muscle-operated cantilever projecting outwardly from said friction slide means and terminating in an outermost, free end, said cantilever being supported at one end only and said one end being adjacent said slide means whereby the entire cantilever moves bodily with the slide means along said structure during said exercising strokes, said cantilever being disposed for effecting said movement of the friction slide means and for selectively maintaining the same rocked either into said second position for quick, generally effortless repositioning movement of the slide means along the structure or into said first position for forceful wiping engagement with said surface upon the application of muscular operating force to the cantilever at said outermost free end, said outermost free end of the cantilever being configured complementally with respect to the terminal part of a human lib for receiving powerful, externally applied, human muscular force from such limb, transmitting the same to said slide means through said cantilever, and relaying said resistive force of the slide means back to said human limb to exercise the latter.

5. An isokinetic exerciser as claimed in claim 4, wherein said structure includes an elongated guide having a rectilinear, longitudinal axis such that said movement of the slide means is rectilinear in nature.

6. An isokinetic exerciser as claimed in claim 4, wherein said slide means is provided with at least a pair of said friction pads situated on opposite sides of said structure and on opposite sides of the longitudinal axis of said cantilever for confining the structure between the pads during said rocking of the cantilever and movement of the latter along the structure.

7. An isokinetic exerciser as claimed in claim 6, wherein said slide means is provided with means adjusting the position of a friction pad on the slide means in a direction to adjust the length of the moment arm between the pad and the cantilever.

8. An isokinetic, muscular exerciser for the human body comprising:

muscle-force opposing structure presenting a surface that generates a resistive force opposing the muscular force applied by the human body during use;

muscle-operated friction slide means reciprocably coupled with said structure for repeated movement in successive exercising strokes along said surface;

a muscle-operated lever coupled with said friction slide means in disposition for effecting said movement of the friction slide means and for maintaining the same rocked by muscular pressure into wiping engagement with said surface upon the application of muscular operating force to the lever at a point spaced outwardly from said surface; and a handle at said outwardly spaced point on said lever configured complementally with respect to the terminal part of a human limb for receiving powerful, externally applied, human muscular force from such limb, transmitting the same to said slide means through said lever, and relaying said resistive force of the slide means back to said human limb to exercise the latter, said lever being extensible for adjusting the length of the moment arm between said surface of the structure and the point of which said muscular force is applied to the lever.

9. An isokinetic, muscular exerciser for the human body comprising:

muscle-force opposing structure presenting a surface that generates a resistive force opposing the muscular force applied by the human body during use;

muscle-operated friction slide means coupled with said structure for repeated movement in successive exercising strokes in opposite directions along said surface, said slide means being coupled with said structure in a manner to permit the slide means to rock about an axis transverse to the path of movement of the slide means in opposite direction between a first position bearing frictionally against the structure and a second position essentially releasing such frictional engagement with the structure;

a muscle-operated lever coupled with said friction slide means in disposition for effecting said movement of the friction slide means and for maintaining the same rocked by muscular pressure into wiping engagement with said surface upon the application of muscular operating force to the lever at a point spaced outwardly from said surface; and a handle at said outwardly spaced point on said lever configured complementally with respect to the terminal part of a human limb for receiving powerful, externally applied, human muscular force from such limb, transmitting the same to said slide means through said lever, and relaying said resistive force of the slide means back to said human limb to exercise the latter, said structure including a guide presenting said surface, said surface being arcuate and being interengaged with said slide means during said movement of the slide means such that said movement is curvilinear in nature.

10. An isokinetic exerciser as claimed in claim 9, wherein said slide means is coupled with said guide for movement along said surface in a path of travel concentric with said surface.

11. An isokinetic exerciser as claimed in claim 10, wherein said guide is provided with a second handle rigidly secured thereto and projecting radially outwardly therefrom, said handle of the lever and said handle of the guide being adapted to be grasped by opposite hands of a user and relatively shifted arcuately along a path of travel extending between the same during use.

* * * * *